US005460110A

United States Patent [19]

Eronen et al.

[11] Patent Number: 5,460,110

[45] Date of Patent: Oct. 24, 1995

[54] METHOD FOR CHANGING THE CHARACTERISTICS OF A SHIP AND A HULL FORM OF AN ICEBREAKING SHIP

[75] Inventors: Harri Eronen, Raisio; Arjo Harjula, Espoo; Reijo Mattila, Turku, all of Finland

[73] Assignee: Insinooritoimisto Lehtonen & Siirila Oy, Turku, Finland

[21] Appl. No.: 129,057

[22] PCT Filed: Apr. 6, 1992

[86] PCT No.: PCT/FI92/00105

§ 371 Date: Jan. 24, 1994

§ 102(e) Date: Jan. 24, 1994

[87] PCT Pub. No.: WO92/17367

PCT Pub. Date: Oct. 15, 1992

[30] Foreign Application Priority Data

| | | | |
|---|---|---|---|
| Apr. 4, 1991 | [FI] | Finland | 911614 |
| Jun. 10, 1991 | [FI] | Finland | 912775 |

[51] Int. Cl.[6] ..... B63B 35/08

[52] U.S. Cl. ..... 114/41; 114/56

[58] Field of Search ..... 114/40–42, 123, 114/56; D12/300

[56] References Cited

U.S. PATENT DOCUMENTS

| | | | |
|---|---|---|---|
| 1,710,625 | 4/1929 | Kapigian | 114/123 |
| 3,727,571 | 4/1973 | Devine | 114/41 |
| 4,831,951 | 5/1989 | Liljeström et al. | 114/41 |

FOREIGN PATENT DOCUMENTS

| | | | |
|---|---|---|---|
| 2212145 | 9/1973 | Germany | 114/40 |

*Primary Examiner*—Edwin L. Swinehart
*Attorney, Agent, or Firm*—Ronald J. Kubovcik

[57] ABSTRACT

A hull for improved seakeeping characteristics of an ice-breaking ship so that the breadth of the ship's hull will be decreased on the aft side of a wide foreship in the vicinity of the waterline. It can be implemented with solid hull form or so that on the side of the hull there is a section removable with respect to the solid hull, location or position of which will be changed with respect to the hull. In the solid structure on the side of the hull there will be formed a recess and above it a reamer, rising towards the stern and formed by a sloping surface. The recess forms a pass between the bilge keel and the reamer becoming wider towards the stern and joining the hull's narrower part of the aft body of the ship.

11 Claims, 12 Drawing Sheets

FIG.10
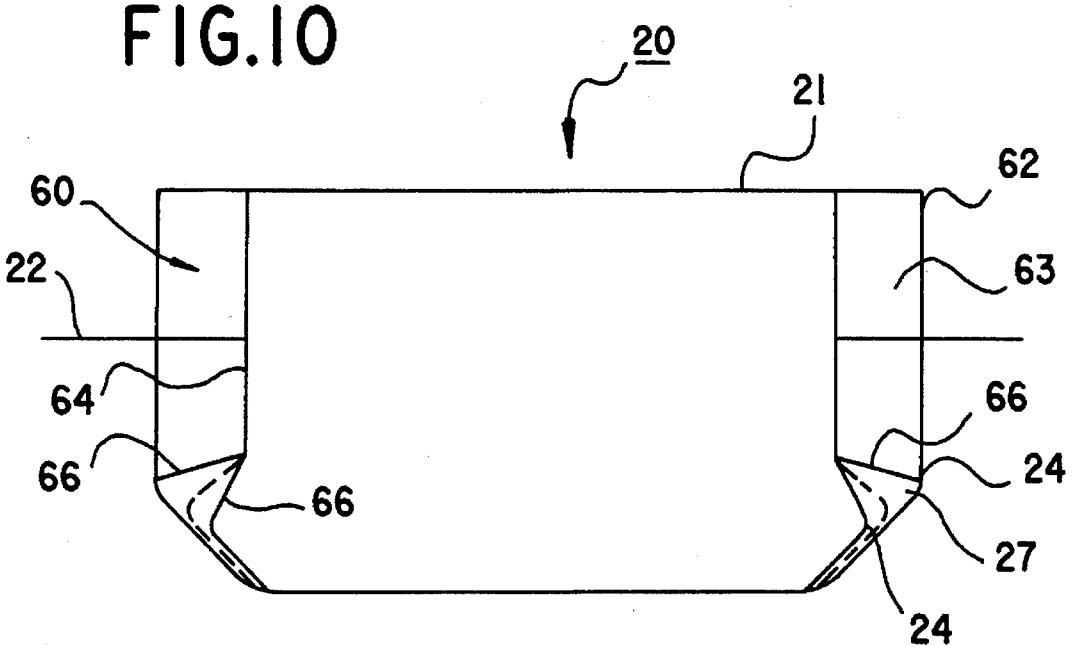
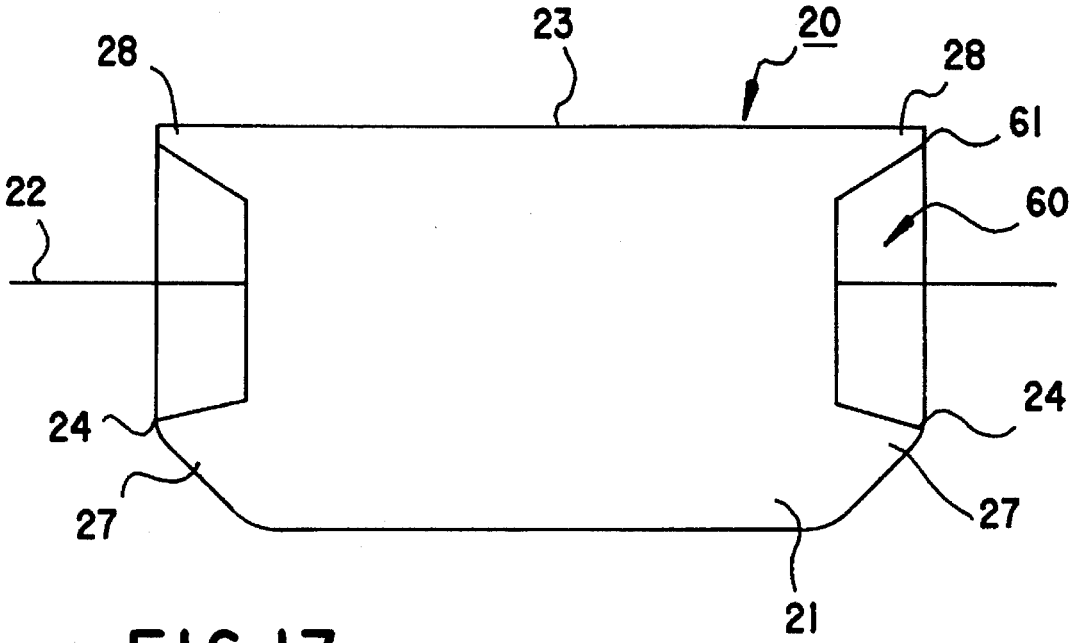
FIG.13

FIG.14
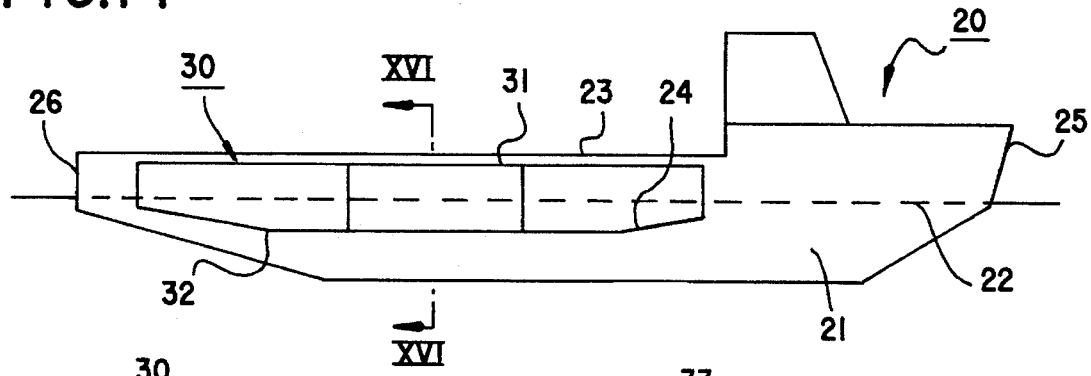
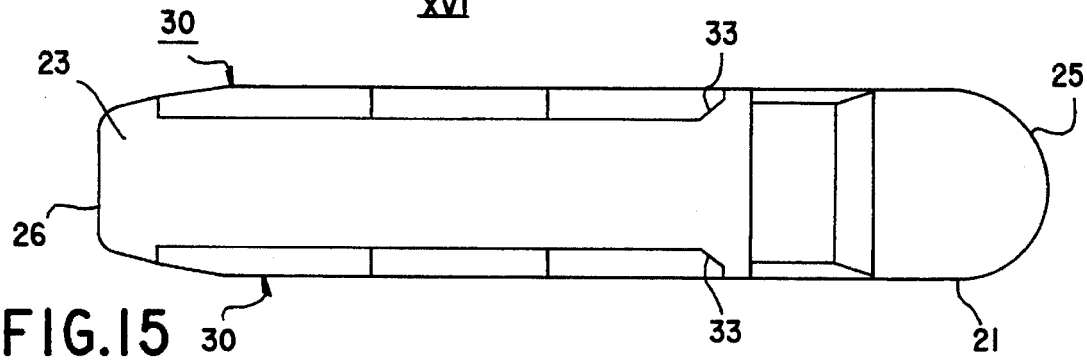
FIG.15
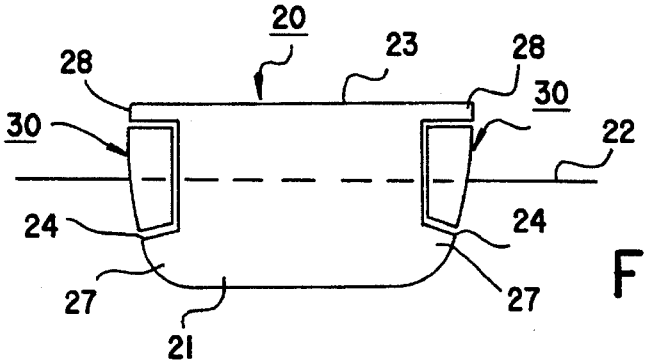
FIG.16
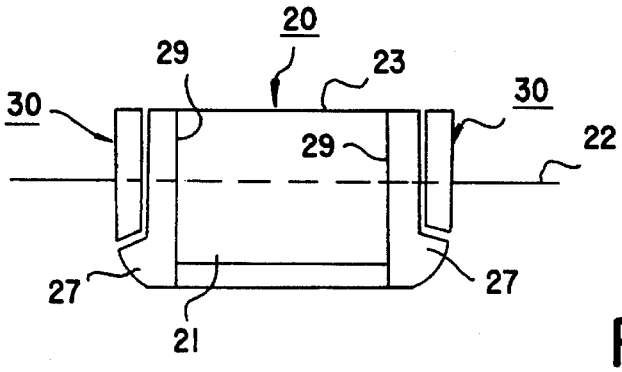
FIG.17

METHOD FOR CHANGING THE CHARACTERISTICS OF A SHIP AND A HULL FORM OF AN ICEBREAKING SHIP

The object of the invention relates to a method for improving the seakeeping characteristics such as the rolling characteristics of an icebreaking ship and a hull form of an icebreaking ship.

One of the problems is shipbuilding is that the hull form of the ship usually is a compromise solution of the required characteristics. If the hull form of the ship is designed to benefit one particular use area only, other characteristics may get worse. One of these objects is the breadth of the ship's hull. There are use areas that require a relatively wide hull. This, however, results in worse seakeeping performance of this kind of vessel.

The above mentioned problem occurs especially in modern icebreakers. Nowadays the main characteristics of an ice-breaker are, in the first place, determined by the breadth of required channel to be formed in the ice. Therefore the aim is to make the icebreakers wide in order to achieve the required breadth of the waterway in ice. There are also cases that the necessity of changing the breadth of the hull can be changed just the opposite. In particular conditions instead of narrow hull a wide hull would be more advantageous for stability reasons.

Eventual draught restrictions and displacement of the vessel also have influence on the hull form of a modern icebreaker. Furthermore, for improving the icebreaker capability and manoeuvrability of the vessel the sides of icebreaker are made sloping and the length-to-breadth ratio of the ship as small as possible. This results in the fact that icebreaker is always relatively wide.

Due to the above, modern icebreakers have developed into effective special vessels showing their best characteristics especially in the winter in icebreaking operations. On the other hand, this kind of specialization in one use area only has also led into disadvantages. Hull of modern icebreakers is much too wide for open water operations, which makes the seakeeping performance considerably worse in open water.

The poor behaving patterns of icebreakers in open water are caused in the first place by too big initial stability of a wide hull. The consequences of this are increased tendency to roll and the fact that rolling has very intensive accelerations in beam seas. Furthermore the hull form of an icebreaker is not apt to dampen efficiently the rolling motion because the side form in an icebreaker is round at bilge.

With bilge keels the seakeeping characteristics of an ordinary sea-going ship can be improved, but in icebreakers they can't be used. Ice causes so much ice loads to the hull of an icebreaker that bilge keels wouldn't withstand it. Without bilge keels a ship with wide hull rolls heavily on rough seas and therefore, accordingly, accelerations of ship are in beam seas one magnitude bigger than in a ship designed for open water use. Thus on rough seas it is difficult, often even impossible to carry out operations on an icebreaker. This essentially limits the open water use of an icebreaker.

On the other hand, however, the operating time of icebreakers in winter is so short that it should be able to use them also in summertime in open water. Suitable tasks would be, for example, towing and supply operations. Good behaviour in open water would be needed also in normal operations of an icebreaker because icebreakers must be able to move long distances also in open water during transfers. On modern icebreakers these transfers are, however, extremely inconvenient. Accelerations onboard can then be so intensive that it's intolerable for human body. So rough seas can make the transfers of an icebreaker impossible to carry out.

The object of the present invention is to eliminate the above mentioned problems. It will be achieved by means of a method according to the invention characterized in that for improving the seakeeping characteristics of an icebreaking ship the hull breadth of the ship will be decreased on the aft side of relatively wide foreship at least in part of the ship's length so that in this area the hull will be narrower mainly in the vicinity of the water line and possibly also above the water line but not in lower part of the hull under water, whereupon due to narrowing of the wide hull there will be a bilge keel formed on both sides of the hull forming an extension to the foreship.

Correspondingly, it is possible, if necessary, to increase the breadth for example of an arctic research vessel or supply vessel. Increased breadth leads to better stability. Especially regarding to the damage stability there are more requirements for hard conditions.

The object of the present invention is also a hull form of an icebreaking ship. The hull form according to the invention is characterized in that on sides of the hull of an icebreaking ship, on the aft side of relatively wide foreship there has been formed or can be formed at least one such recess or narrowed-off place, where at least a part of ship's hull in this area is narrower than the foreship mainly in the vicinity of the water line and possibly also above the water line but not in the lower part of the hull under water, whereupon due to narrowing of the wide hull after the foreship there will be formed a bilge keel on both sides of the hull in this area forming an extension to the foreship at least in part of the ship's hull.

The structure according to the invention enables for example an icebreaking ship to be formed so that it can be used also in open water because its seakeeping characteristics will be improved. Thus it has been achieved a combined hull form for an icebreaking and for a vessel meant to be used in open water.

According to the present invention the hull of an icebreaker can be narrowed for open water use so much that the ship's initial stability decreases to the same level as in normal sea-going supply ships. This means that is beam seas the motions of an icebreaker can be achieved as pleasant as of other open sea vessels without having to content with worse hull form in icebreaking operations. Thus the possibilities to use modern icebreakers for open water operations can be essentially improved.

According to a preferred embodiment the combined icebreaker and ship for open water use can be achieved so that on sides of the ship's hull there are side tanks consisting of one section or several sections which are ment to be removed in open water operations, the removal of these tanks decreasing the ship's stability to a level suitable for open water operations.

After removing the removable side tank sections there will be in the bilge section of the ship's hull roll dampening projections formed which at the same time operate as bilge keels of the ship thus dampening the ship's rolling. The bilge keels also decrease the heaving and pitching of the ship. Furthermore, the said side structure enables to keep a wide working deck though the stability of the ship otherwise corresponds to a narrower ship.

In the main deck of the ship there can be an overhang in the area of the removable side tanks, thus the ship's cargo deck has a full width.

The overhang of the deck and the bilge projections thus form fenders corresponding to the double side. Thus by means of the deck overhang and bilge shape there will be on the sides of the ship a protecting structure which replaces the wide double side required for supply vessels.

It can be considered that the most important advantage of the present invention is the fact that hull form of the ship remains the best possible both for icebreaking and open water operations thus making possible and profittable to use an icebreaker type ship for example as a supply ship. Also the safety of the crew will be improved during open water operations.

The removable tank sections can be attached to the ship's hull in many different ways. The attachment can be done, for example, by means of mechanical fixing means, by hydraulic means or by partly welding the removable side sections into the ship's hull. In practice, the strength of the joints will also be increased by the fact that in winter during icebreaking operations the water will freeze between the removable tank sections and hull thus acting as an equalizer for the local stresses directed to the tanks and joints.

The transportation of the removable tank sections onto ship's side and out of it can be carried out alternatively by means of a crane, by floating using ballast in tanks or by means of an attaching device designed especially for that purpose. The removable tank sections can also be maintained and repaired in suitable conditions ashore without disturbing the ship's operations, because during the open water season the ship operates without removable tank sections.

According to another preferred embodiment the ship's hull form is characterized in that on the both sides of the hull there has been formed at least one such recess or narrowed-off place which makes at least a part of the ship's hull narrower at least in the area of the water line thus improving the seakeeping characteristics of the ship.

The structure according to the invention enables achieving, for example, an icebreaking vessel which is possible to use also in open water operations. For this purpose on the both sides of an icebreaker's hull there has been formed at least one recess, thus decreasing the breadth of ship's hull at least in the area of the water line and improving the seakeeping characteristics of the ship in open water operations.

The invention establishes a combined hull form of an ice-breaker and sea-going ship for open water operations.

According to the present invention the hull of an icebreaker can be made so much narrower for open water operations that the initial stability of the ship decreases to the same level as in normal sea-going supply ships. This means that the motions of an icebreaker in beam seas can be made as good as on other sea-going ships without having to content with worse hull form in icebreaking operations. Thus the possibilities to use modern icebreakers for open water operations can be essentially improved.

Below the recesses there will be in the bilge section of the ship's hull roll dampening projections formed which at the same time operate as bilge keels of the ship thus dampening the ship's rolling. The bilge keels also decrease heaving and pitching of the ship. Furthermore, the said side structure enables to keep a wide working deck though the stability of the ship otherwise corresponds to a narrower ship.

In the area of recesses there can be an overhang in the main deck, thus the ship's cargo deck having full width.

The overhang of the deck and the bilge projections thus form fenders corresponding to the double side. Thus by means of the deck overhang and bilge shape there will be on the sides of the ship a protecting structure which replaces the wide double side required for supply vessels.

It can be considered that the most important advantage of the present invention is the fact that hull form of the ship remains the best possible both for icebreaking and open water operations thus making possible and profitable to use an icebreaker type ship for example as a supply ship. Also the safety of the crew will be improved during open water operations.

According to another preferred embodiment on the ship's hull on the aft side of the wide foreship there has been formed a appendage or reamer connected to the recess, the lower surface of the reamer being formed by sloping surface that rises up towards aftship and thus forming the upper surface of the recess. This means that the recess will be preferably formed between the bilge keel and the reamer so that the recess forms a pass between the bilge keel and the reamer, the said pass becoming wider towards the aftship joining the narrower part of the aftship hull. This kind of structure makes the ship suitable both for icebreaking and for open water operations.

The invention is in the following described by the aid of examples referring to the attached drawings where FIG. 1 shows the side view of a hull form of a ship according to an embodiment of the invention.

Figure 1:
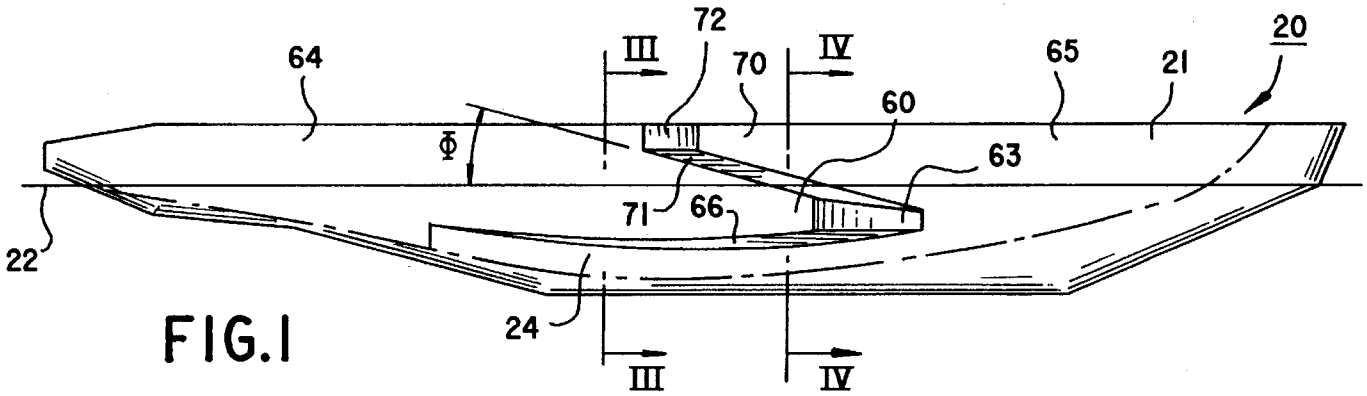
Figure 5:
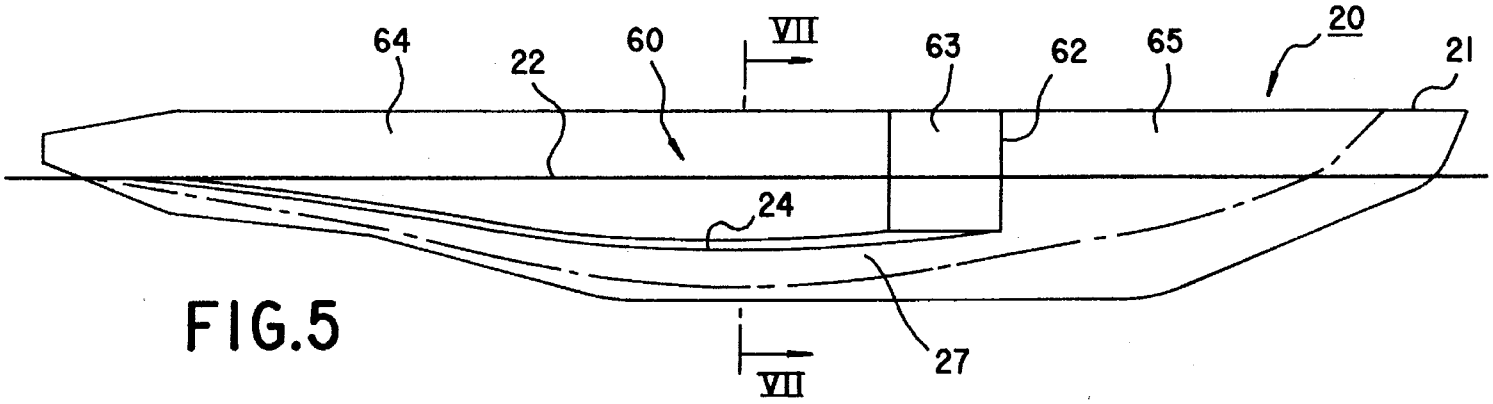

FIG. 5 corresponds to FIG. 1 and shows a side view of a hull form of a ship according to the second embodiment.

Figure 6:
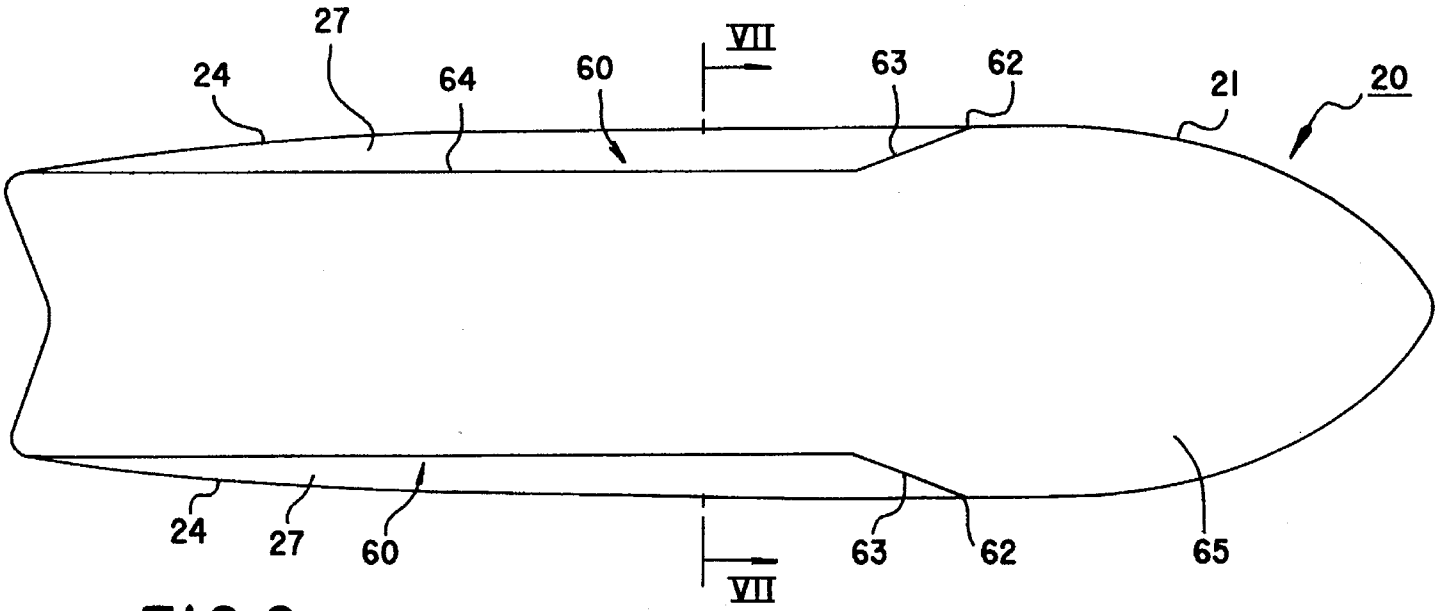

FIG. 6 shows the top view of the hull form of the ship in FIG. 5.

Figure 7:
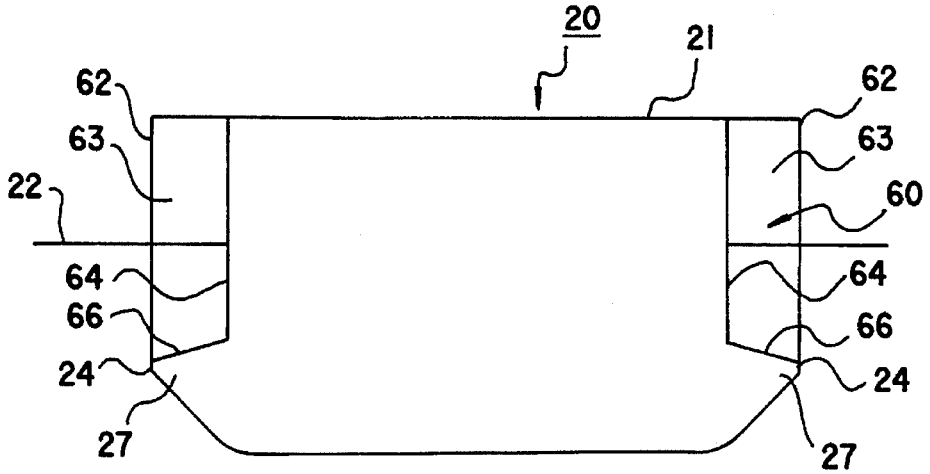

FIG. 7 shows a section along the line VII—VII in FIG. 5.

Figure 8:
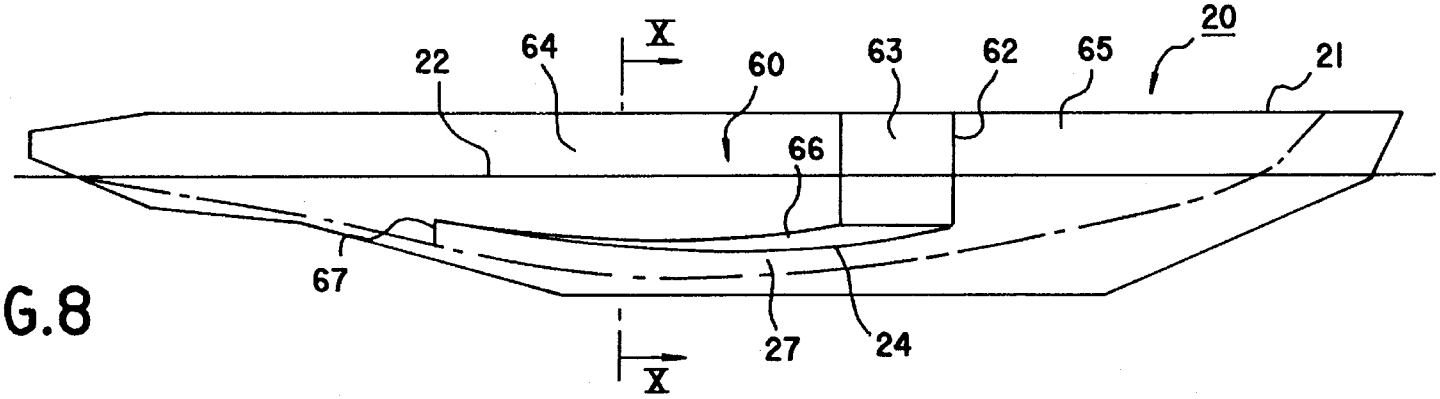

FIG. 8 corresponds to FIG. 1 and shows a side view of a hull form of a ship according to the third embodiment.

Figure 9:
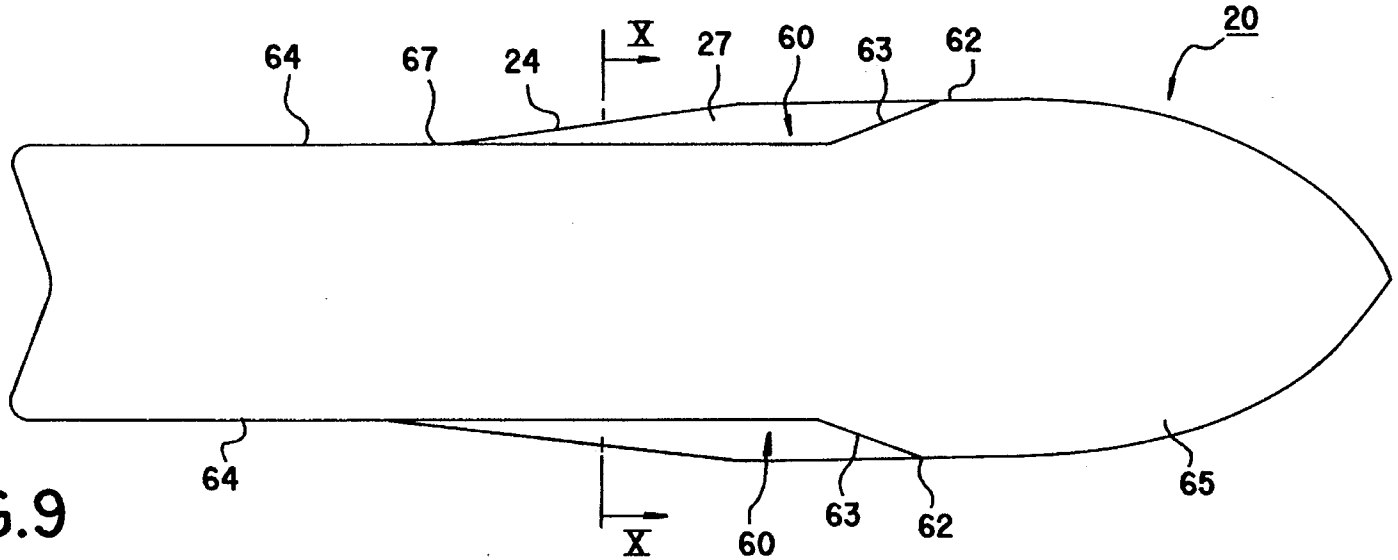

FIG. 9 shows the top view of a hull form of the ship in FIG. 8.

FIG. 10 shows a section along the line X—X in FIG. 8.

Figure 11:
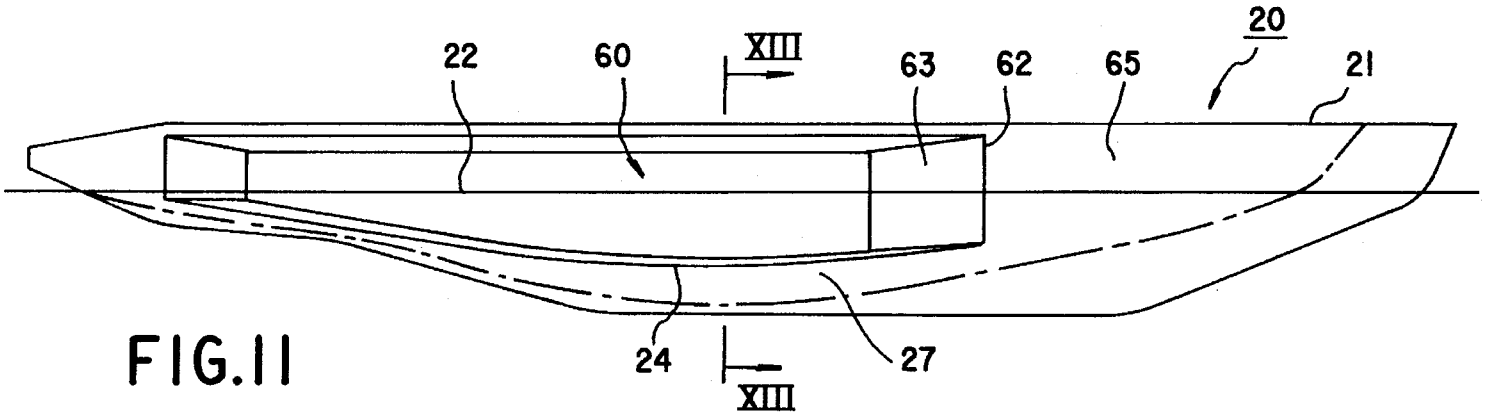

FIG. 11 corresponds to FIG. 1 and shows a side view of a hull form of a ship according to the fourth embodiment.

Figure 12:
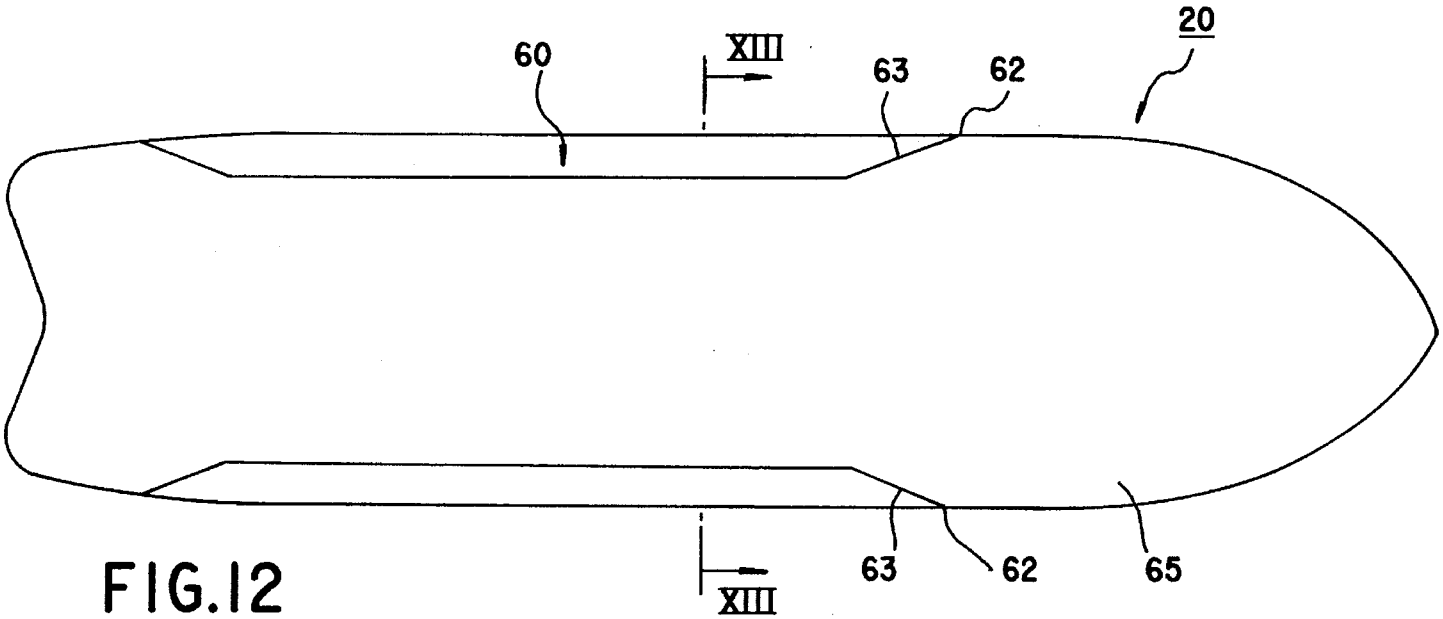

FIG. 12 shows a section along the line XII—XII in FIG. 11.

FIG. 13 shows a section along the line XIII—XIII in FIG. 11.

FIG. 14 corresponds to FIG. 1 and shows schematically a side view of a hull form of a ship according to the fifth embodiment including the side structure provided with the removable side sections according to the present invention.

FIG. 15 shows the top view of the ship in FIG. 14.

FIG. 16 shows a section along the line XVI—XVI in FIG. 14.

FIG. 17 corresponds to FIG. 16 and shows a cross section of a ship provided with a different side structure.

Figure 18:
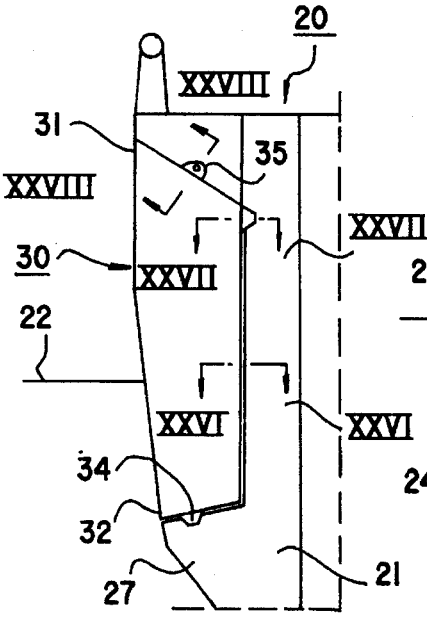

FIG. 18 shows a detail of a cross section of a ship's side structure with a separate removable side section attached.

Figure 19:
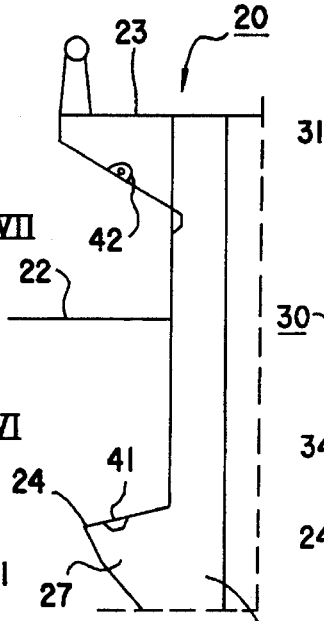

FIG. 19 corresponds to FIG. 18 and shows a detail of the cross section of the ship's side structure with the separate section removed.

Figure 20:
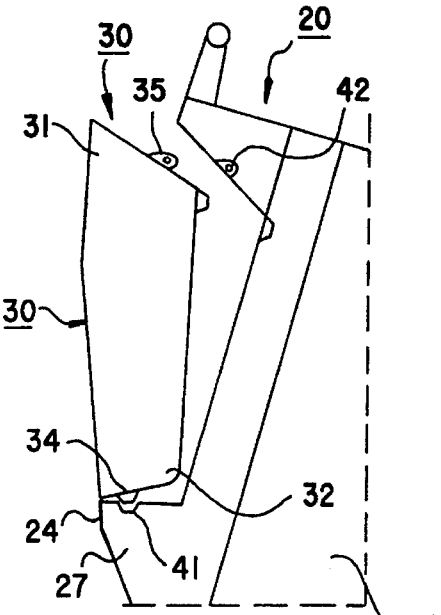

FIG. 20 shows schematically the changing of the ship's side structure.

Figure 21:
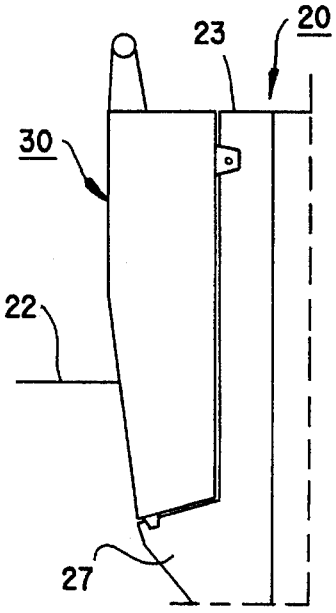

FIG. 21 corresponds to FIG. 18 and shows the second embodiment of a detail of the ship's side structure according to FIG. 17.

Figure 22:
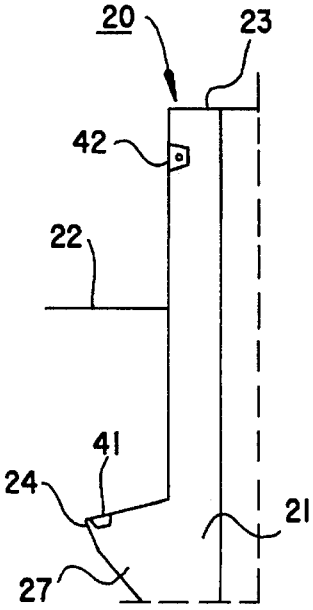

FIG. 22 corresponds to FIG. 21 and shows a detail of the ship's side structure with the separate section removed.

Figure 23:
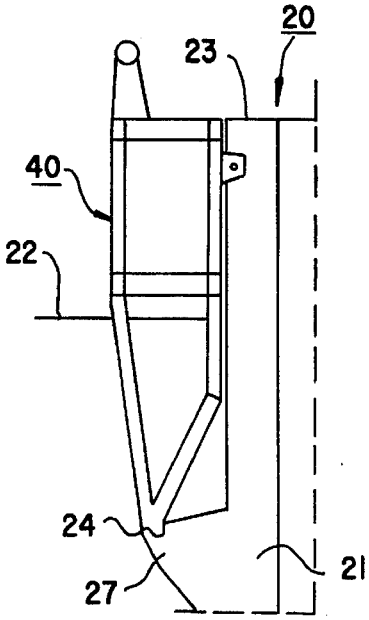

FIG. 23 corresponds to FIG. 21 and shows a detail of the ship's side structure according to the third embodiment.

Figure 24:
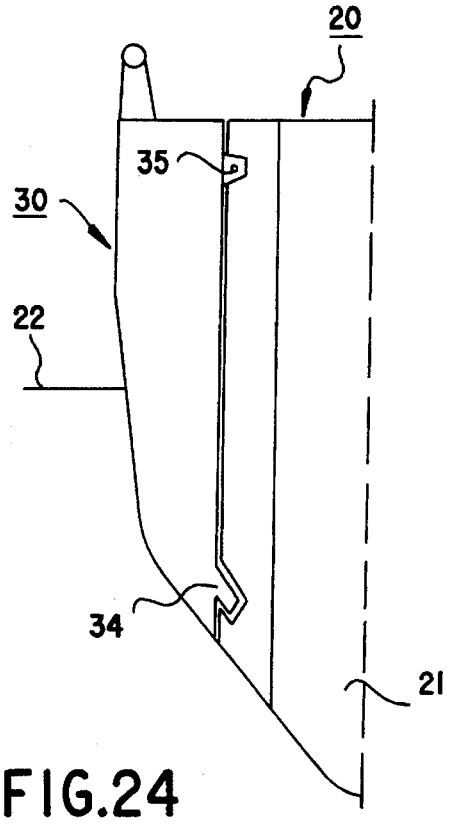

FIG. 24 corresponds to FIG. 18 and shows a detail of the ship's side structure according to the fourth embodiment.

Figure 25:
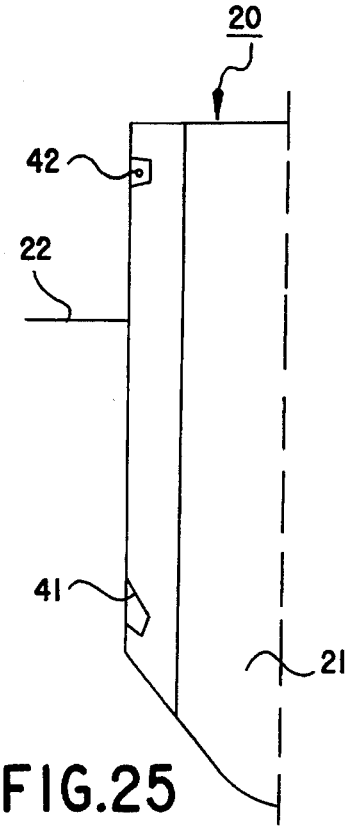

FIG. 25 corresponds to FIG. 24 and shows a detail of the ship's side structure with the separate section removed.

Figure 26:
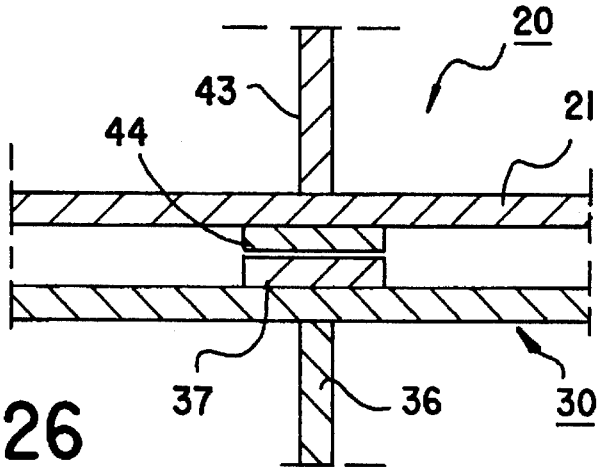

FIG. 26 shows a section of the ship's side structure along the line XXVI—XXVI in FIG. 18.

Figure 27:
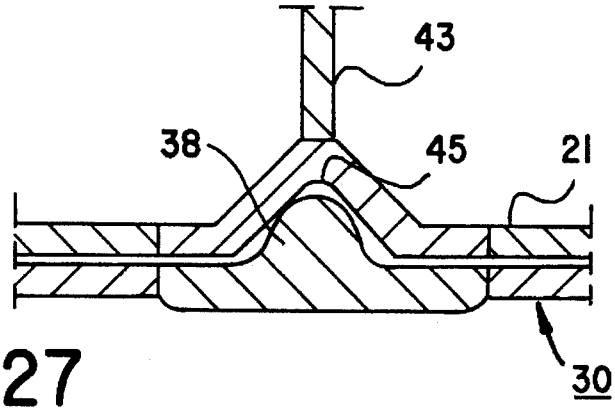

FIG. 27 shows a section of the ship's side structure along the line XXVII—XXVII in FIG. 18.

Figure 28:
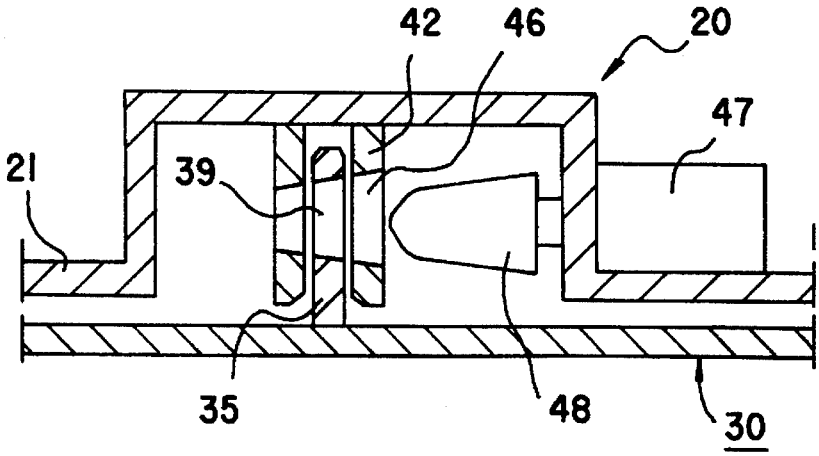

FIG. 28 shows a section of a locking part of the ship's side structure along the line XXVIII—XXVIII in FIG. 18.

Figure 29:
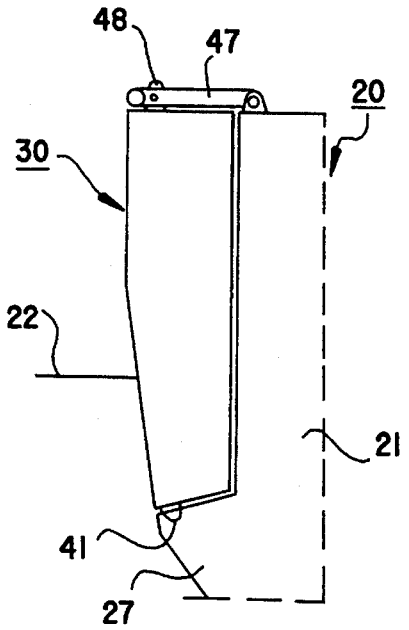

FIG. 29 corresponds to FIG. 21 and shows the fifth embodiment of the side structure.

Figure 30:
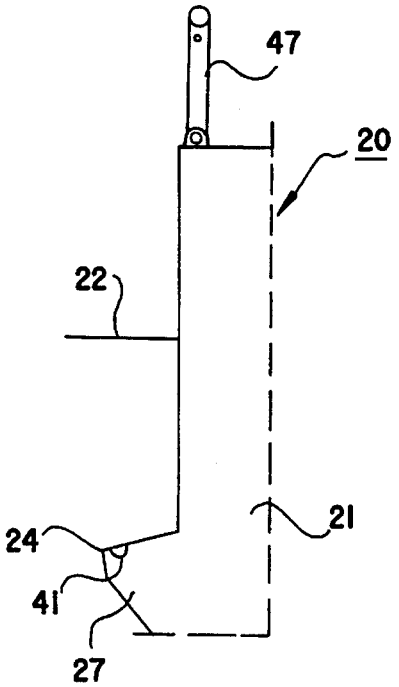

FIG. 30 corresponds to FIG. 29 with the separate section removed.

Figure 31:
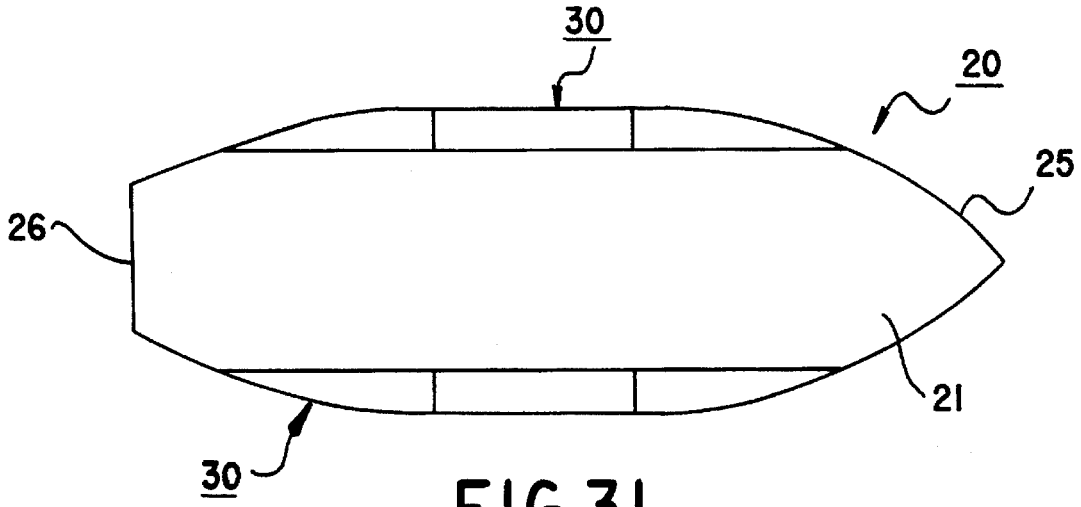

FIG. 31 corresponds to FIG. 15 and shows a top view of a ship according to the sixth embodiment.

Figure 32:
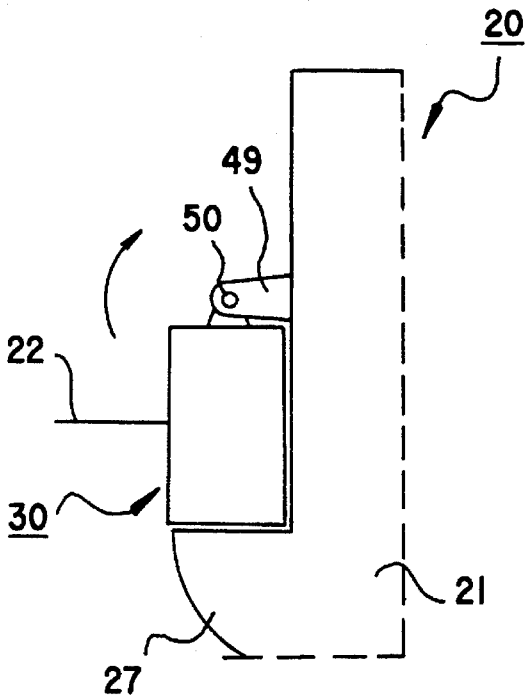

FIG. 32 corresponds to FIG. 29 and shows the sixth embodiment of the side structure.

Figure 33:
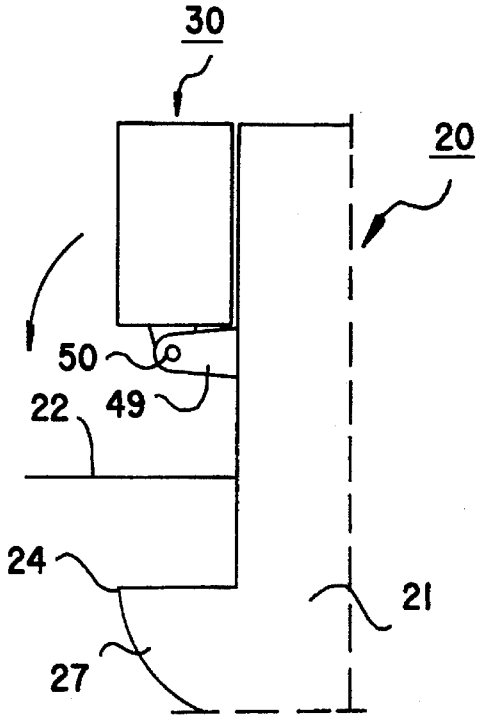

FIG. 33 corresponds to FIG. 32 with the separate section turned to another position.

Figure 34:
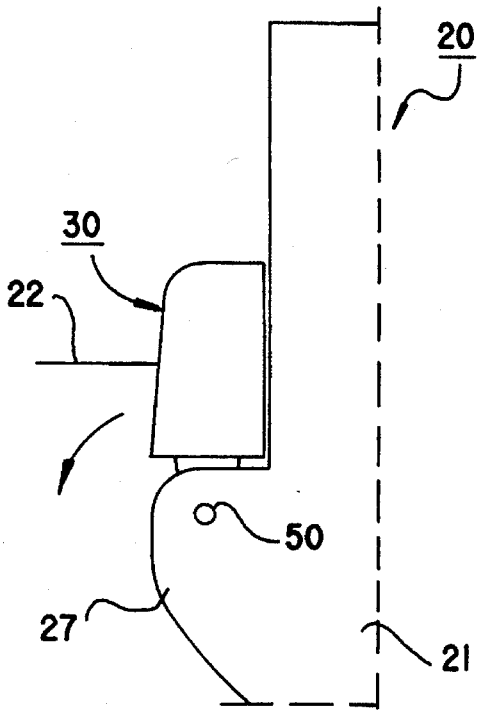

FIG. 34 corresponds to FIG. 32 and shows the seventh embodiment of the side structure.

Figure 35:
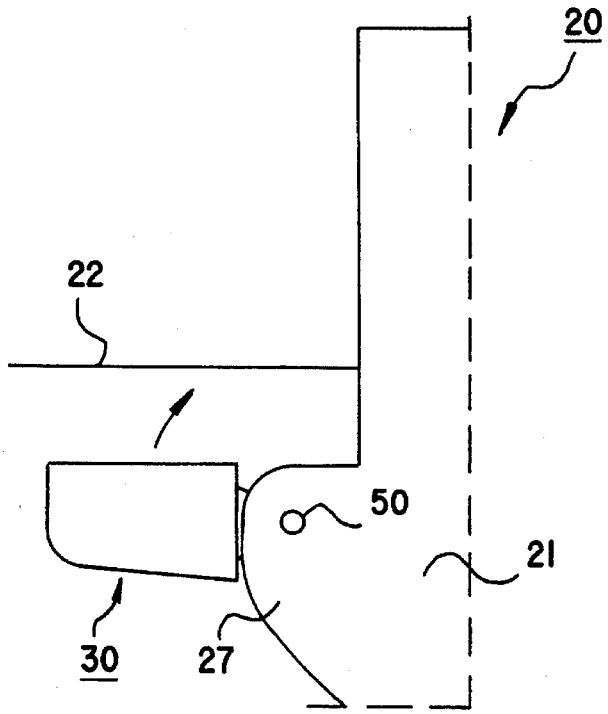

FIG. 35 corresponds to FIG. 34 with the separate section moved to another place regarding to the ship's hull.

Figure 36:
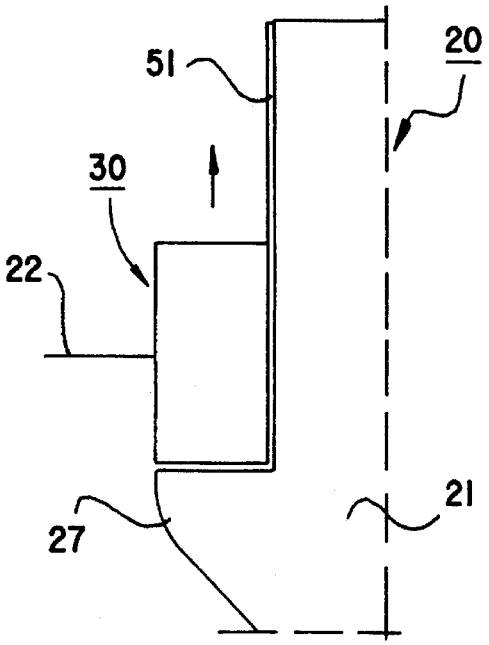

FIG. 36 corresponds to FIG. 32 and shows the eighth embodiment of the side structure.

Figure 37:
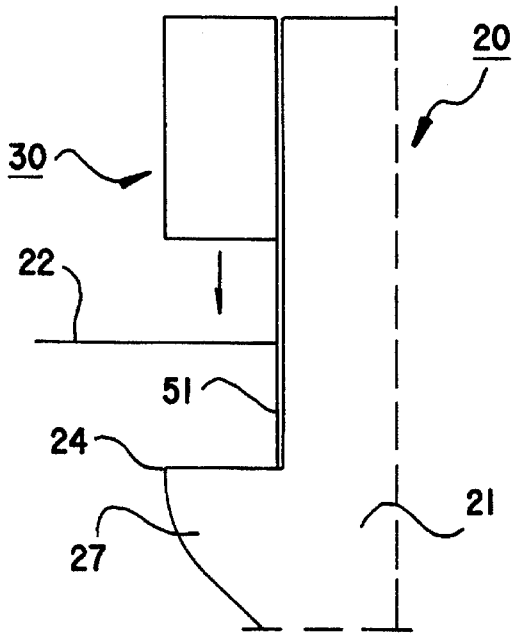

FIG. 37 corresponds to FIG. 36 with the separate section moved to another place regarding to the ship's hull.

In FIG. 1 is shown a side view of a ship's full form 20, where the breadth of fore body 65 of the hull 21 corresponds to conventional relatively wide icebreaker, whereas the aft body 64 is formed clearly narrower than the fore body 65. Narrowing of the hull 21 has been implemented so that in the mid body on both sides of the hull in the vicinity of the water surface 22 there have been formed recesses 60, above and below of which the hull 21, however, still continues in wide shape some distance towards the aft ship. The recess 60 is thus formed between the surface 63, 66 and 71.

Surface 63 is mainly vertical surface which forms the narrowing. Surface 71 above the recess 60 is the lower surface of the appendage 70 or reamer and surface 66 situating below is the upper surface of the bilge keel 24. The purpose of the recess 60 and the narrower aft body 64 of the hull 21 connected to it is to improve the ship's seakeeping characteristics.

Appendage 70 or reamer is meant to break the ice while the ship is moving backwards. That's why the sloping lower surface 71 of appendage 70 has been placed into the area of the water surface 22 i.e. the ice to be broken so that one part of the reamer 70 is above the water surface and another part is below it. The sloping lower surface 71 of the reamer 70 is sloping in respect with both the longitudinal axis and transversal axis of the ship. Lengthwise the angle $\Phi$ of the sloping lower surface 71 of the reamer 70 in respect with the water surface 22 is, for example, 15°20°, in most advantageous case 15°. The bilge keel 24 is formed in the area of the recess 60 in mid body of the ship's hull 21 as an extension of wide fore body. Slop of its upper surface is about 15° in respect with the horizontal plane.

Figure 2:
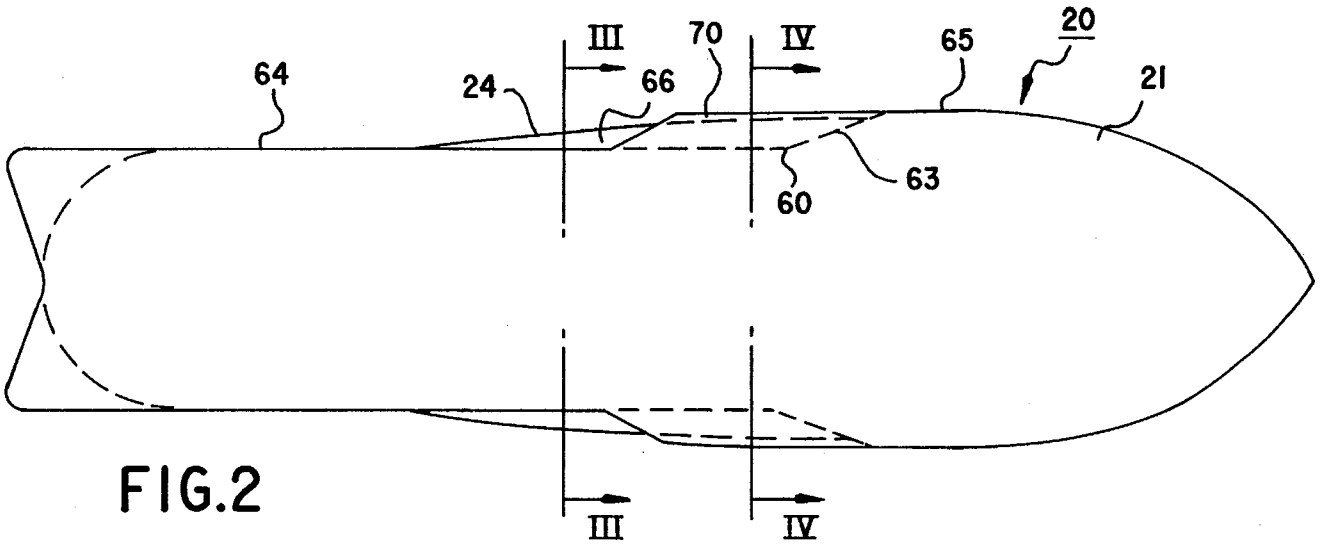
FIG. 2 shows the top view of the hull form of the ship in FIG. 1.

FIG. 2 shows the top view of the hull 21 of the ship of FIG. 1. The figure shows that the fore body 65 of the hull 21 is wide and aft body 64 is narrower. Broken line shows the recesses 60 on the sides of the hull 21, which are staing between the bilge keel 24 and reamer 70. As shows in the figure the breadth of the hull in the area of the bilge keel 24 is not quire as broad as in the area of the reamer 70. This due to the fact that the sides of the hull 21 are sloping. Because the hull 21 thus in its lower part is narrower than in its upper part, accordingly the hull is narrower also in the area of the bilge keel 24.

Figure 3:
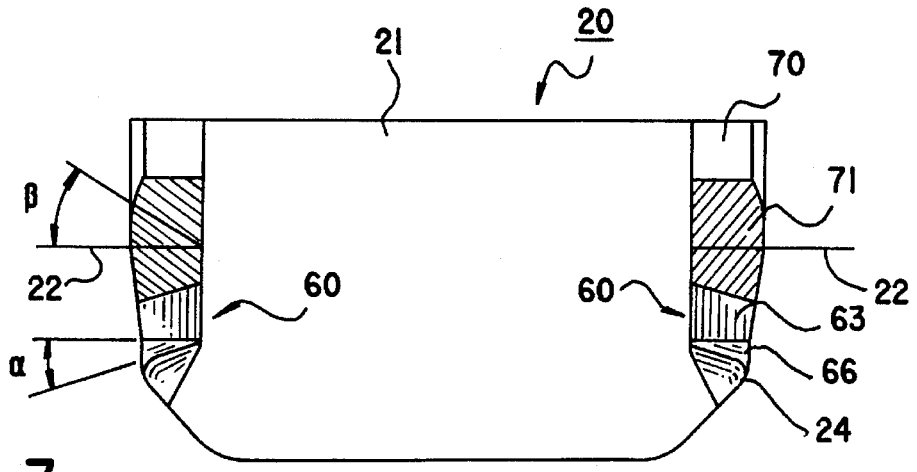
FIG. 3 shows a section along the line III—III in FIG. 1.

The section presented in FIG. 3 shows how the ship's hull 21 according to the invention is narrow in its aft body i.e. in the area of the section and aft from it. At front of the section or in its fore body the ship is wider. Near the narrowed place on both sides of the hull 21 there are formed recesses 60 which are situated between the sloping upper surface 66 of the bilge keel 24 situated under the water surface 22 and the sloping lower surface 71 of the appendage 70 or reamer. Front of the recess 70 adjoins on a wedge-shaped, mainly vertical surface 63.

FIG. 3 shows that amidships the outer surfaces of the bilge keel 24 and reamer 70 principally follow the outer dimensions of the ship's hull 21. Because icebreaking ship is concerned, the fore body of the hull must be relatively wide so that a channel of sufficient width would be formed in the ice but, on the other hand, the sides must also be slightly sloping. That's why the maximum breadth of the bilge keel 24 is smaller than the maximum breadth of the reamer 70. At the same time the bilge keel 24 is also protected by the side so that the bilge keel won't crash into the quay.

FIG. 3 also shows that during the backing the sloping lower surface 71 of icebreaking reamer 70 reaches above the water surface 22 as well as below it. This sloping surface 71 has been inclined in respect with both the longitudinal axis of the ship 20, as can be seen in FIG. 1, and the transversal axis of the ship. The angle $\beta$ of the sloping surface 71 showed in FIG. 3 in crosswise direction regarding the water surface 22 is, for example, between 0°–45°, preferably 30°.

The angle $\alpha$ of the upper surface 66 of the bilge keel 24 regarding the water surface 22 is not constant. The cross section of FIG. 3 shows that at its least this angle is, for example, 15°, but in the narrower aft body of the ship 20 the bilge keel becomes smaller and approaches the ship's side.

Figure 4:
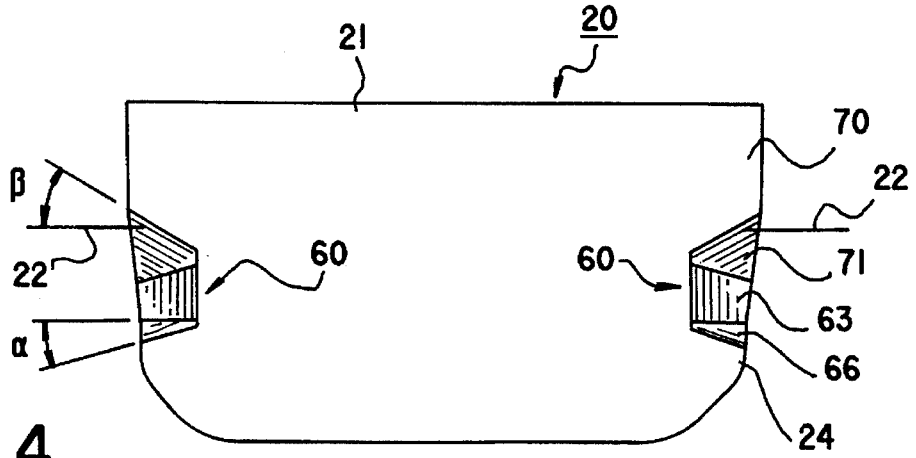
FIG. 4 shows a section along the line IV—IV in FIG. 1.

In FIG. 4 is shown another cross section of the ship 20 further illustrating the shape of recesses 60 on the sides of the ship 20. From the figure can be seen that the ship's hull 21 is in fore body quite conventional bow of an icebreaking ship, but after fore body towards the aft body on the sides of the ship have been formed these recesses 60. Recesses 60 are directed in wedge shape towards the center line of the ship all the way to the breadth of the aft body. The recesses are limited to the upper surface 66 of the bilge keel 24, lower surface 71 of the reamer 70 and wedge-shaped narrowing surface 63.

In FIG. 5 is shown the side view of the hull 21 of the ship 20 according to the invention and in FIG. 6 is shown the corresponding top view of the hull. In this embodiment the fore body 65 of the hull 21 is formed by conventional fore body of an icebreaker. Wide fore body, however, becomes narrower from point 62 towards the aft body. After wedge-shaped narrowing surface 63 the aft body 64 of the hull 21 is above the water line 22 straight and clearly narrower than the fore body 65.

The narrowing, which begins from point 62 of the hull's 21 fore body 65, however, concerns only the area near the water line 22 of the hull 21 and part of the hull above it. Below the water line 22 also in the aft side of the narrowing surface 63 the hull shape has a wide area. This shape can clearly be seen in the cross section of the hull 21 in FIG. 27. Also in the narrowed place in the lower part of the hull 21 remains bilge 27, which reaches to breadth of the hull's fore body 65 and functions as a bilge keel increasing the stability of the ship 20. In this embodiment the hull's side in the area of the bilge keel is mainly vertical and the upper surface 66 of the bilge keel forms an angle of about 15° with the horizontal plane.

It can be see from the FIG. 5 the arched shape of the bilge keel 27 in the side view. The curve of the outermost edge 24 of the bilge corresponds to the arched shape of the hull 21 i.e. the shape of the bilge keel 27 corresponds to the direction of the water flow against the hull.

FIG. 6 shows that in this embodiment the bilge keel 27 becomes smoothly narrower towards the aft body of the ship 20 and the edge 24 of the bilge keel 27 joins the narrowed, mainly vertical side 64 of the hull only quite in the aftship.

In the FIGS. 8 ja 9 is shows the second embodiment of the ship's hull 21, where the bilge keel 27 don't reach the aftship of the hull 21. The narrowing of the hull 21 begins from the same point 62 as in the example above, but the bilge keel 27 joins the narrowed side 64 of the aft body already in point 67.

Thus in narrowed area of the aft body of the ship 20 will be formed an area, where the side of the hull 21 is mainly vertical without any appendages directed to the side. Vertical area of the side without any appendages plays a significant role in the loading operations of the ship.

Design of the aft body of the ship's 20 hull 21 is of importance also to water flow caused by the propeller during the backing. For icebreakers it is advantageous if the water flow caused by propeller goes upwards and washes the hull's 21 side during the backing. Thus the friction between the hull and ice decreases and the movements of the ship in ice becomes easier. The washing effect can be further improved by using a known air bubbling system, which is not described in this application.

FIG. 10 shows that the upper surface 66 of the bilge keel, which near the narrowed area 63 forms an angle of about 15° together with the horizontal plane, turns to more vertical position towards the aft body of the hull. In the cross section point of FIG. 10 this angle is already about 60°. In other words, while the bilge keel 27 becomes narrower towards the aft body of the ship 20, its slope changes and it gradually merges into the mainly vertical side 64 of the aft body hull.

The smooth merging of the bilge keel 27 into the shape of the ship's 20 hull 21 decreases the hull's flow resistance when the ship is moving ahead, but it is useful also during the backing. This kind of design causes effectively the water flow against the icebreaker's hull 21 during the backing as described above. Shortened bilge keel according to this embodiment is in many cases sufficient for achieving suitable stability characteristics.

FIGS. 11 and 12 show the third embodiment of the invention, where on the side of the ship's 20 hull 21 have been formed recesses 60 so that narrowing of the hull is formed only in the area of the water line 22. Both in the foreship and aftship the hull 21 is wider. The hull is wider also below the water line 22, where will be formed a bilge keel 27, which is nearly as long as the whole length of the ship, and above the water line, where is an overhang 28 of the deck 23. The overhang 28 is so big that the deck 23 is as wide as the hull 21 at the bilge keel 27. FIG. 13 shows the shape of the cross section according to this embodiment.

It can be seen from FIG. 13 that the shape of the recesses 60 has been adapted to the shape of the ship's hull 21 so that their upper edge 61 follows the line of the deck 23 and lower edge is of arched shape according to the shape of the hull 21. The arched formed of the lower edge 62 follows the arched part of the hull 21 below the recess 60 where thus will be formed an arched bilge keel 27, which is nearly as long as the whole length of the ship 20.

FIG. 14 shows schematically a side view of a ship 20 provided with side structure according to invention. It can be seen from the figure that on the both sides of the ship's hull 21 in the area of the water line 22 there are formed removable sections 30. According to invention these sections 30 are, for example, tanks which can be attached to side of the ship 20 so that in fixed position they form a part of the ship's hull 21. For practical reasons the tanks 30 have been divided into smaller parts. In example shown in FIG. 14 there are three tanks on both sides of the ship.

The shape of tanks 30 corresponds to the shape of the ship's hull 21 so that their upper edge 31 follows the line of the deck 23 and lower edge 32 has arched shape according to the shape of the hull 21. The arched shape of the lower edge 32 results in the fact that the arched part 24 of the hull 21 below the tanks 30 forms an arched bilge keel when the tanks 30 are removed. This situation has been showed in FIGS. 19 and 22.

FIG. 15 shows the top view of the ship according to FIG. 14. It can be seen from the figure that when the tanks 30 are in their place attached to the hull 21, the ship's hull form corresponds to wide hull of an icebreaker. When the tanks 30 are removed, the ship's hull becomes essentially narrower in the water line, thus a hull form suitable for open water operations will be achieved. According to invention this makes possible to achieve a hull form which can be designed to be suitable both for icebreaking and open water operations.

The tanks 30 decreasing the breadth of the ship's 20 hull 21 can consist of one section only or several separate removable sections. In example shown by FIGS. 14 and 15 three tanks 30 have been attached to each side of the ship.

Tanks 30 preferably reach in the foreship 25 the area, where the hull 21 begins to become narrower in the lower part of the tank. Thus the hull's 21 foreship 25, which in the icebreaker pushes ice sidewards, consists mainly of the solid hull. This arrangement decreases longitudinal forces directed towards the removable sections 30. The front edges 33 of the most forward tanks are bevelled in order to decrease the flow resistance of the hull 21 in open water operations when the tanks 30 have been removed from the hull 21.

In the aft body 26 of the ship 20 the removable tanks preferably reach the area, where their breadth in the area of the water line 22 remains small. Thus design of the hull 21 does not cause any additional resistance. Naturally the hull 21 can be designed alternatively so that the tanks 30 end in aft body 26 to an appendage equivalent to that in the fore body 25.

FIG. 16 shows a section taken from the FIG. 14 along the line XVI—XVI, which is an example of cross section of ship according to the invention. It can be seen from FIG. 16 that the removable tanks 30 attached to side of the hull 21 of the ship 20 reach from the area of the upper edge of the ship's bilge 27 to the main deck 23. Main deck 23 has the breadth of the maximum breadth of the ship's hull 21 and removable side tanks 30 have been attached below the overhang 28 of the deck 21.

When the removable side tanks 30 of the ship in FIG. 16 are removed, in the ship's hull 21 will be formed appendage 24, which functions as a bilge keel dampening the rolling of the ship 20. Looking from the side, profile of the appendage 24, which forms the bilge keel, can be straight or arched as shown in FIG. 14. For minimizing the moving resistance of the ship 20 arched form of the bilge keel 24 is advantageously to be designed so that it corresponds to direction of the water flow around the hull 21 of the ship 20.

The overhang 28 of the deck 21 of ship 20 and the bilge keel 24 also function as appendages, which form fenders when the ship is used for supply operations. They replace in the area of removable side tanks 30 the double side, which is normally required for supply ship.

FIG. 17 shows another example of cross section of the ship corresponding to FIG. 16. In this alternative main deck 23 of the ship 20 is in the area of removable side tanks 30 narrower and the removable side tanks 30 come above the water surface 22 at least the distance required for icebreaking operations. In the solution shown by the figure double side required by the supply ship rules can be done by means of the bulkheads 29.

FIG. 18 shows a detail of cross section of the side structure of the ship corresponding to invention in icebreaking situation. Thus the removable side tanks 30 are attached to the ship's 20 hull 21. Attachment can be done many different ways by means of mechanical fixing devices, hydraulics or by welding the removable side tanks partly to the ship's hull. In the example shown by FIG. 18 the tank 30 has been attached so that in the lower edge 32 of the tank 30 there is a locking part 34, which fits the corresponding hole in the ship's hull 21. The upper edge 31 of the tank 30 has been locked by means of locking ear 35. This locking has been described in more details in FIG. 28.

FIG. 19 shows cross section of the side structure of the ship 20 corresponding to FIG. 18 in open water operation. It can be seen from the figure that when the tank 30 has been removed, the ship's breadth in the area of the water line 22 is essentially decreased. It results in the fact that the rolling period of the ship decreases and also the rolling acceleration essentially decreases. Furthermore the behaviour of the ship 20 in rough seas is settled down by the angle 24 of the hull 21, which thus forms the bilge keel. After this the behaviour of the ship is very much the same as that of a sea-going ship designed for open water operations. From the water line 22 it can be noticed that loading the ship with bigger loads now has been possible, thus its draught has increased.

FIG. 20 shows schematically the movement of the removable side tank 30 to the ship's 20 side and away from it. In this example the ship 20 is to be inclined so much that tank 30 can be lifted by means of a crane to its place and away from it. When fixing the tank 30 to its place it is at first to be laid on the bilge keel 24 of the ship's 20 hull 21 so that the locking part 34 situated in the lower edge 32 of the tank 30 goes into corresponding hole 41 in the hull 21. After that tank 30 can be let press against the hull 21 and the upper edge 32 of the tank 30 is to be locked by means of the locking ear 35 to the corresponding ear 42 in the hull 21. By removing the tanks 30 from the hull it is easy to carry out their maintenance and repair in suitable conditions without disturbing the ship's operations.

FIG. 21 show the second embodiment of a detail of the side structure of the ship 20 according to FIG. 17 in icebreaking situation. This figure differs from the corresponding FIG. 18 in that the tank 30 is higher reaching level of the deck 23. Thus the deck 23 of the ship 20 becomes narrower when the tank 30 is removed. FIG. 22 shows this situation when the ship operates in open water.

FIG. 23 shows an alternative to open water operation of FIG. 22. Here to side of the ship 20 has been attached framework 40, dimensions and attachment of which correspond to the tank 30 used in the winter. Purpose of the framework 40 is to form a fender on the ship's side. At the same time, deck 23 becomes also in open water operations as wide as the max. breadth of the ship. Because structure of the framework 40 is open, it doesn't affect rolling and heaving characteristics of the ship.

FIG. 24 shows the side structure of the ship 20 with vertical side. Here the lower part of the tank 30 is resting on the locking part 34 and its upper part has been locked by locking ear 35. In FIG. 25 the ship 20 is without removable side tank 30. This kind of structure is concerned when no bilge keel is used in the ship.

FIG. 26 shows a section of a detail of the ship's side structure. The structure of removable side tank 30 is such that its bulkhead 36 and bulkhead 43 of the ship's hull 21 are on the same place. Furthermore there are supporting pieces 37 and 44 between them.

FIG. 27 shows another detail of the ship's side structure. In ship's hull 21 there is a guide hole 45 where the corresponding quide notch 38 leans on. The guide notch 38 takes the longitudinal stresses caused by attachment of the tanks 30. In icebreaking operations it is advantageous, that water between the removable side tanks and the ship's hull freezes. This freezing equalizes the local stresses directed towards the joints.

FIG. 28 shows a detail of the locking part of the ship's side structure. When attaching the tank 30, the locking ear 35 in the upper part of the tank 30 goes into the hole in the ship's hull 21, where is corresponding locking ear 42. In locking situation the wedge-shaped piston 48 of the hydraulic cylinder 47 goes into holes 35 and 46 in both ears 35 and 42 thus locking the tank 30 to the hull 21 of the ship 20.

FIG. 29 shows an embodiment where the upper part of the removable side tank 30 has been attached to the hull 21 of the ship 20 by means of a rail 47. Here the rail 47 has been turned onto the tank 30 and locked into the ear 48 on the tank 30. In FIG. 17 the removable side tank 30 has been removed, thus the rail 47 has been raised up.

FIG. 31 shows the top view of the ship's hull corresponding to FIG. 15. In this embodiment the hull 21 of the ship 20 is built, however, such that it is mainly used without the removable side tanks 30. If necessary, they can, however, be added as shown in FIG. 31.

In the embodiment shown in FIG. 32 and 33 on the hull 21 of the ship 20 has been attached a separate section by means of appendage 49 and joint 50. In FIG. 32 the section 30 has been turned round the joint 50 into lower position, in which case the ship 20 can be used, for example, as an icebreaker. In FIG. 33 section 30 has been turned up and the breadth of the ship 20 at the water line 22 has decreased. Characteristics of the ship 20 are now advantageous in open water operations.

FIG. 34 shows an embodiment wherein the separate section 30 of the hull 21 of the ship 20 has been turned towards the hull 21, for example, for icebreaking situation. In next FIG. 22 section 30 has been turned round the joint 50 into horizontal position. Here the section 30 forms together with the solid bilge appendage 27 in the hull an extremely effective bilge keel.

FIGS. 36 and 37 show an embodiment wherein the separate section 30 has been attached to the hull 21 of the ship 20 into vertical guides 51. In FIG. 36 section 30 is in its lower position and the hull 21 of the ship 20 at the water line 22 is wide. In FIG. 37 section 30 has been raised up in guides 51 when the hull 21 of the ship 20 is at the water line 22 narrow and below the water line is formed the bilge keel 27.

For those skilled in the art it is clear that the different embodiments of the invention can vary within the scope of the patent claims.

We claim:

1. A hull form of a monohull icebreaking ship wherein on the sides of the hull aft of a relatively wide foreship there is formed at least one recess, wherein at least part of the hull is in this place narrower than the foreship in the vicinity of the waterline, and wherein due to narrowing of the wide hull after the foreship there are sidewards directed steps beneath the waterline on both sides of the hull forming an extension to the foreship and serving as bilge keels to dampen the rolling of the ship, wherein on the hull of the ship, on the aft side of said wide foreship is a reamer connected to the recess.

2. A hull form of an icebreaking ship according to claim 1, wherein the bilge keels possess a length which is at least part of a length of said recess.

3. A hull form of a ship according to claim 2, wherein the recess and the bilge keel located below the waterline are at least in the midbody of the ship.

4. A hull form of a ship according to claim 2, wherein the recess is found in the midbody of the ship and extends to the stern.

5. A hull form of a ship according to claim 2, wherein in the midbody of the ship the bilge keel, which is as wide as the nominal beam tapers narrowly to the stern, and that in the aft body of the ship the bilge keel smoothly joins the narrowed, essentially vertical side of the hull.

6. A hull form of a ship according to claim 2, wherein in the midbody of the ship the bilge keel, which is as wide as the nominal beam, ends essentially before the stern so that towards the aftship the upper surface of the bilge keel, which is at an angle of 0°–20° with respect to the horizontal plane, tapers to a more upright position smoothly joining the mainly vertical, narrowed side of the hull.

7. A hull form of a ship according to claim 1, wherein a deck of the ship has in the area of the recess at least in part of length of the recess mainly the same width as in the area of the hull without narrowing so that in this area of the ship is a work deck with full width in spite of the narrowing of the hull's waterline.

8. A hull form of a monohull icebreaking ship according to claim 34, wherein stepped bilge keels are located in the midbody of the hull, and the sides of the narrowed at body of the hull are without appendages and substantially vertical so that water flow caused by a propeller washes the side during backing.

9. A hull form of a ship wherein on the sides of the hull aft of a relatively wide foreship there is formed at least one recess, wherein at least part of the hull is in this place narrower than the foreship in the vicinity of the waterline, and wherein due to narrowing of the wide hull after the foreship there are sidewards directed steps beneath the waterline on both sides of the hull forming an extension to the foreship and serving as bilge keels to dampen the rolling of the ship, and wherein on the hull of the ship, on the aft side of said wide foreship is a reamer connected to the recess, wherein the lower surface of the reamer is a sloping surface rising towards the stern of the ship, which at the same time forms the upper surface of the recess.

10. A hull form of a ship wherein on the sides of the hull aft of a relatively wide foreship there is formed at least one recess, wherein at least part of the hull is in this place narrower than the foreship in the vicinity of the waterline, and wherein due to narrowing of the wide hull after the foreship there are sidewards directed steps beneath the waterline on both sides of the hull forming an extension to the foreship and serving as bilge keels to dampen the rolling of the ship, and wherein on the hull of the ship, on the aft side of said wide foreship is a reamer connected to the recess, wherein the recess is located between the bilge keel and reamer.

11. A hull form of a ship wherein on the sides of the hull aft of a relatively wide foreship there is formed at least one recess, wherein at least part of the hull is in this place narrower than the foreship in the vicinity of the waterline, and wherein due to narrowing of the wide hull after the foreship there are sidewards directed steps beneath the centerline on both sides of the hull forming an extension to the foreship and serving as bilge keels to dampen the rolling of the ship, and wherein on the hull of the ship, on the aft side of said wide foreship is a reamer connected to the recess, wherein the recess is between the bilge keel and reamer and forms a passage, which is wider towards the stern of the ship and joins the narrower part of the hull of the ship's aft body.

* * * * *